United States Patent [19]

Morrison

[11] 4,009,984

[45] Mar. 1, 1977

[54] VAPOR INJECTION SYSTEM FOR FUEL COMBUSTION

[76] Inventor: Charles F. Morrison, 25 Pearl St., Malden, Mass. 02148

[22] Filed: Mar. 8, 1976

[21] Appl. No.: 664,967

[52] U.S. Cl. ..... 431/4; 431/190

[51] Int. Cl.[2] ..... F23J 7/00

[58] Field of Search ..... 431/3, 4, 190; 261/18 A; 123/25 R

[56] References Cited

UNITED STATES PATENTS

| | | | |
|---|---|---|---|
| 3,862,819 | 1/1975 | Wentworth | 431/4 |
| 3,901,644 | 8/1975 | Armas | 431/4 X |
| 3,924,648 | 12/1975 | Etter | 431/4 X |
| 3,938,933 | 2/1976 | Armas | 431/4 |

*Primary Examiner*—Edward G. Favors
*Attorney, Agent, or Firm*—Richard L. Stevens

[57] ABSTRACT

A vapor injector for use with a fuel combustion system which system has an air intake assembly and a combustion area. The vaporizer includes a platform floating on a reservoir of water. A vacuum chamber is defined by the platform and the surface of the reservoir. The volume of the chamber remains constant regardless of the level of the reservoir. The vaporizer is connected to the air intake assembly. A negative pressure is applied to the chamber and a saturated air stream flows from the chamber and into the combustion area.

10 Claims, 5 Drawing Figures

VAPOR INJECTION SYSTEM FOR FUEL COMBUSTION

BACKGROUND AND BRIEF SUMMARY OF THE INVENTION

In fossil fuel burners it is well known that the addition of water vapor enhances the combustion efficiency. Introduction of water vapor may be solely by positive pressure, U.S. Pat. No. 3,724,429; negative pressure (vacuum), U.S. Pat. No. 3,107,657; or both positive and negative pressure, U.S. Pat. No. 3,862,819. In this last-mentioned patent, the concept of water vapor introduced into a combustion chamber is applied to central heating units, such as oil heaters. This patent provides a fuel catalyzer which has a first conduit from the high pressure side of the fan associated with the oil burner to a position below a reservoir of water. A second conduit transports water vapor to the downstream side of the fan from a chamber above the reservoir.

The device disclosed in U.S. Pat. No. 3,862,819 has several drawbacks. The physical defacement of the oil burner by drilling holes in the fan housing has met with consumer resistance because the oil suppliers claim it affects the mechanical performance of the oil burner. Also, the holes affect oil burner warranties. A more serious drawback is that the liquid level in the reservoir constantly varies and the needle valve arrangement disclosed therein has not been found satisfactory. Depending upon the water level in the reservoir, the pressure will vary. As the water level decreases, it results in more moisture or vapor being introduced into the combustion area, lessening the effectiveness of the combustion for which the system was originally designed. On days of high humidity, it is possible for the water level in the reservoir to exceed the predetermined water level, resulting in a lessening of pressure and decrease in the amount of water vapor introduced into the ignition area, again lessening the efficiency of the combustion.

This constant varying of the water level and therefore the vapor in the chamber results in an uneven metering of the water vapor.

Another drawback is that for different sizes of central heating units, structurally different sizes of orifices for the fuel catalyzers are required.

The present invention is directed to a system for introducing water vapor into a combustion area and the method for operating the same. The invention carefully regulates the metering of water vapor into the combustion area of a heating unit without altering the heating unit structurally. The invention employs only negative pressure (vacuum) and avoids fluctuation in the water level of a reservoir by employing a free floating platform which maintains a constant vapor chamber.

The invention in one embodiment comprises a vacuum-tight housing, a reservoir of water in the housing, and a constant vapor chamber disposed above the reservoir. A vacuum is created in the vapor chamber, which results in an airflow being drawn into the housing and through the reservoir. The airflow entrains metered amounts of highly vaporized water molecules which flow into the vapor chamber and ultimately into the combustion chamber. In a preferred embodiment, a liquid level control system is disposed within the housing to control the liquid level, and the volume of the vapor chamber.

In the preferred embodiment, a vacuum fan is in communication with the power source of the heating unit and provides a secondary airstream. A conduit from the vacuum fan to the housing creates the vacuum for an airflow through the reservoir and the water vapor flows through the conduit, the vacuum fan, and into the combustion zone.

DESCRIPTION OF THE PREFERRED EMBODIMENT

Figure 1:
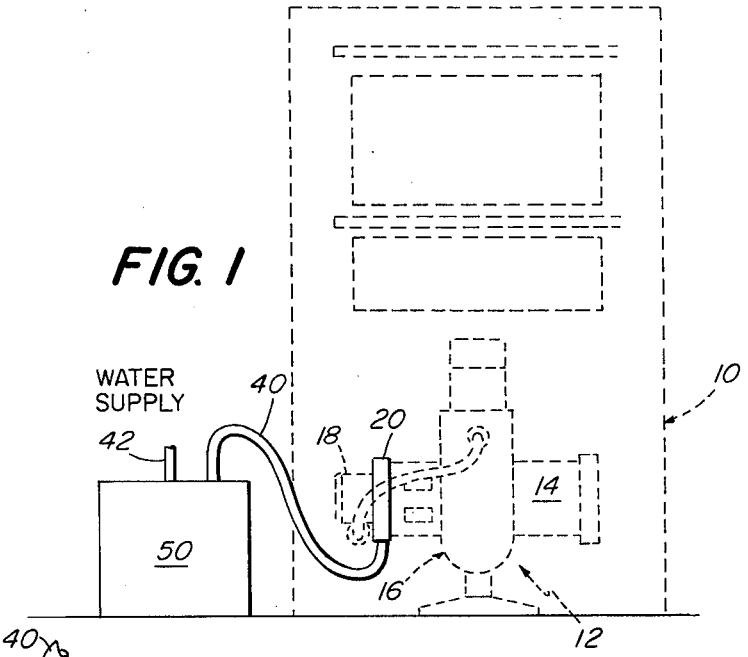
FIG. 1 is a front schematic of a conventional oil burner in combination with an embodiment of the invention.

Referring to FIG. 1, a conventional furnace 10 and oil burner 12 are shown in dotted lines. The oil burner typically comprises a motor 14, a fan housing and air intake assembly 16 and an oil pump 18. A vapor injector 50 communicates with a vacuum fan 20 via conduit 40. A water inlet 42 is secured to the top of vapor injector 50.

Figure 2:
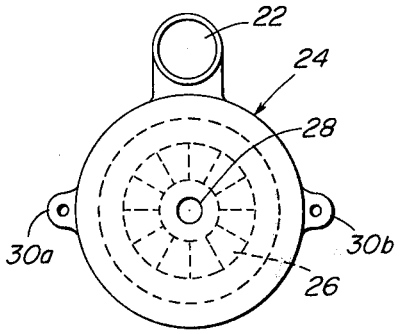
FIG. 2 is a front sectional view of a vacuum fan.

In FIG. 2, the vacuum fan 20 is shown and includes an air intake 22, a housing 24, a blade assembly 26 and shaft 28. For purposes of this invention, the fan is modified by securing lugs 30*a* and 30*b* to the housing. The vacuum fan 20 is conventional and is secured between the oil pump 18 and the fan housing and air intake assembly 16. Alternatively, it may be disposed between the assembly 16 and the motor 14.

Figure 3:
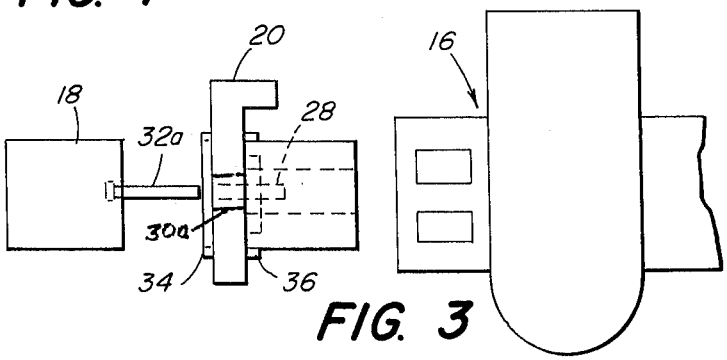
FIG. 3 is a side view of the fan of FIG. 2.

The oil pump 18 is removed and the fan 20 is disposed between the pump 18 and the fan housing 16. In FIG. 3, the pump 18 is shown schematically. When assembled, the shaft 28 of the fan 20 is coupled to the shafts of the pump 18 and fan within the housing 16. The oil pump 18 on such burners is secured to the fan housing 16 by screws 32*a* and 32*b*. When assembled, these screws pass through the lugs 30*a* and 30*b*. Seals 34 and 36 are disposed between the abutted surfaces of the fan 20 and pump 18, and the fan 20 and housing 18. The coupling of the shafts may be accomplished in any suitable manner, such as pinning, splicing, etc.

Figure 4:
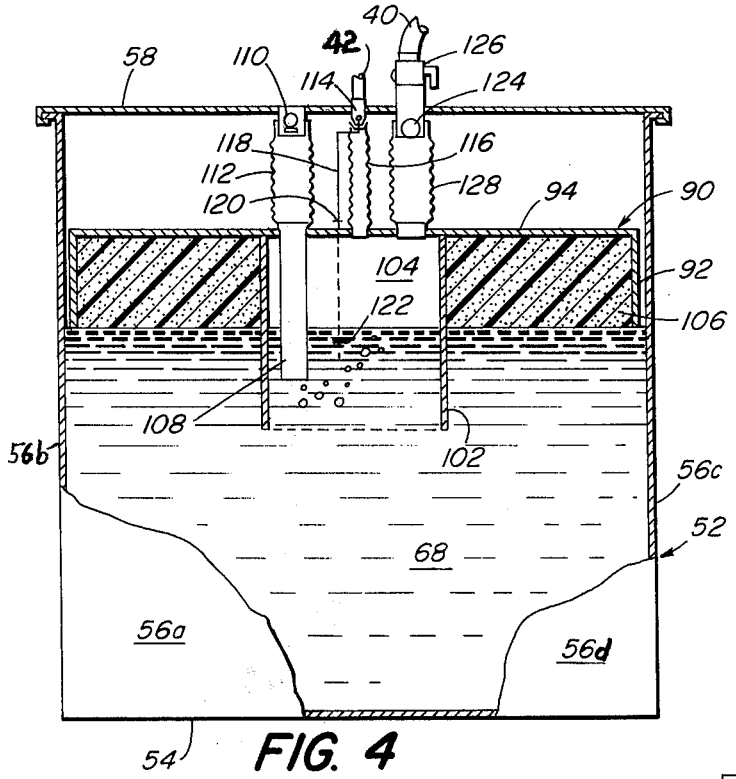
FIG. 4 is a front partially sectional view of a water injector embodying the invention.

Referring to FIG. 4, the vapor injector 50 is shown in greater detail and comprises a rectangular shaped housing 52 having a bottom plate 54 and front, side and back walls 56*a*, 56*b*, 56*c* and 56*d*. A top plate 58 is secured to the walls of the housing.

The housing 52 has a reservoir of water 68 which carries a free floating platform 90 having an outer depending wall 92 which is spaced apart from the inner surface of the walls 56*a*, 56*b*, 56*c* and 56*d* and an upper plate 94. Secured to the upper plate 94 in a seal-tight manner is a sleeve 102 which extends into the reservoir 68. The inner surface of the sleeve 102, the surface of the water in the reservoir 68 and the lower surface of the upper plate 94 define a vapor chamber 104. A foam-like material 106, such as close-celled polystyrene, is disposed between the depending walls 92 and the tube 102 and has a planar lower surface which contacts the surface of the reservoir 68.

A tube 108 is secured to the plate 94 and extends at one end beyond the upper surface of the plate 94 and at its other end through the chamber 104 and into the reservoir 68.

A tube 102 is secured in a vacuum-tight manner.

A spring loaded pressure sensitive ball valve 110 is secured to top plate 58 and connected to the tube 108 by a flexible accordian-type conduit 112.

An automatic mechanically responsive off-on water valve 114 is secured to the plate 58. a flexible accordian-type conduit 116 connects the valve 114 to the plate 94. A rod 118 is secured to the valve 114 and passes through the platform 90 and not through the chamber 104. Upper and lower collars 120 and 122 are secured to the rod 118. The valve 114 is connected to a water supply line 42.

A pressure sensitive ball valve 124 in combination with a manual adjust valve 126 is secured to plate 58. A flexible accordian-type conduit 128 connects the valve 124 to plate 90.

The operation of the invention will be described in reference to the introduction of water vapor into a combustion area. However, it is to be understood that it may be used in any application wherein it is described to meter particles into a fluid stream at a constant rate for any purpose.

In the operation of the invention, the platform 90 is disposed in the housing 52 and floats on the surface of the reservoir 68. If at any time the water in the reservoir 68 appreciably drops, the platform 90 will engage the collar 122, turning on the valve 114. Water will fill the reservoir until the platform engages the upper collar 120 shutting off the valve 114.

It is important to note that at all times the relationship between the volume of the chamber 104 and the depth of the tube 102 entering the reservoir 68 is fixed. For any particular environment, the flow rate may be controlled by the valve 126.

When the oil burner is actuated, the fan in the housing and the vacuum fan 20 both rotate. The vacuum fan 20 creates a negative pressure in the conduit 40. However, at this time, the valve 126 is closed. The flame in the combustion area is examined. Normally, the outer periphery of the flame is spaced well apart from the wall of the combustion chamber or the fire box as it is commonly referred to. The valve 126 is then opened.

The vacuum fan 20, such as an in-line fan, for example the type fan employed in hand-held hair driers, such as found in the Schick Hair Drier Moded No. PD1200, creates a vacuum in the line which causes the ball in the ball valve 124 to deflect upwardly. When the valve 124 opens, a vacuum is created in the chamber 104. This creates a pressure differential between the chamber 104 and the ambient environment about the vapor injector 50. This differential results in the valve 110 opening by the downward deflection of the ball. To attempt to equalize this pressure differential, air passes through the valve 110, conduit 112 and tube 108 and enters the reservoir 68. The air passes through the reservoir 68 and enters the chamber 104 with entrained water vapor forming a saturated air stream. This stream flows through conduit 128, valves 124 and 126, conduit 40 and into the main stream of combustion air and finally into the combustion area. When the water vapor enters the combustion area, the flame enlarges. The valve 126 is adjusted until the flame is substantially adjacent but not contacting the walls of the fire box. At this point, the system is calibrated.

If desired, the rate of oil flow may be adjusted downwardly and the amount of water vapor increased to maximize efficiency. When the amount of water vapor is too great, the flame will begin to suffocate and accordingly, the flow rate of water vapor is reduced. There are two variables, the flow rate of the oil and the flow rate of the water vapor, which are adjusted until as described above the flame is adjacent but not touching the walls of the fire box.

Figure 5:
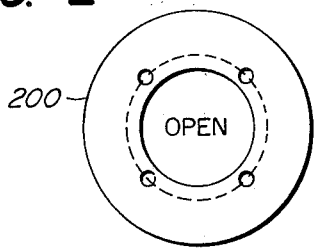
FIG. 5 is a plan view of a baffle.

If desired, the vacuum fan 20 may be eliminated and the conduit 40 secured to the low pressure side of the fan housing 16 such as shown in U.S. Pat. No. 3,862,819. Because the sizes and types of burners vary considerably, to increase the drawing power of such an arrangement by restricting the air passage through the fan housing 16, as shown in FIG. 5, a baffle 200 may be interposed in the normal intake air opening upstream of the fan and downstream of the air intake openings of the assembly 16 substantially perpendicular to the axis of rotation of the fan.

Accordingly, my invention embodies the vapor injector used alone, used in combination with a vacuum fan; or used in combination with some baffling device to limit the normal air intake.

Having described my invention, what I now claim is:

1. An apparatus for adding water vapor to a fossil fuel combustion system, which system has an air intake assembly for introducing a flow of air into the combustion area of the combustion system, which comprises:

a. a housing having a reservoir of water disposed therein;

b. a platform disposed in the housing and in vacuum-sealing floating engagement with the reservoir, the platform including:

i. a depending sleeve-like member fixedly secured to the platform and extending into the reservoir, the inner surface of the member and the upper surface of the reservoir defining a vapor chamber;

ii. a depending tube-like member fixedly secured to the platform and extending through the vapor chamber and into the reservoir;

c. first valve means to seal the tube-like member, said valve means in communication with the ambient environment, which valve means opens when there is a pressure differential between the vapor chamber and the ambient environment;

d. second valve means to seal the vapor chamber from the ambient environment, said valve means adapted to open when there is a pressure differential between the vapor chamber and the ambient environment;

e. a conduit secured to the second valve means and the air intake assembly of the combustion system; and f. means to create a pressure differential between the ambient environment about the housing and the vapor chamber to draw air through the first valve, through the water, and into the vapor chamber, forming a saturated air stream, which air stream flows through the second valve and into the air intake assembly.

2. The apparatus of claim 1, which includes:

means to control the level of water in the reservoir.

3. The apparatus of claim 1, which includes:

a lid member to enclose the housing, said member removably secured to the housing above the platform, the first and second valve means secured to the lid member;

a first flexible conduit secured to the platform and in communication with the first valve means and the tube-like member; and a second flexible conduit secured to the platform and in communication with the second valve means and the vapor chamber, whereby the platform may move with the water level while the volume of the vapor chamber remains constant.

4. The apparatus of claim 3, which includes:

means to control the water level in the reservoir.

5. The apparatus of claim 1, wherein the means to create a pressure differential includes:

means to create a vacuum secured to the air intake assembly.

6. The apparatus of claim 5, wherein the means to create a vacuum includes:

a vacuum pump secured to the air intake assembly and adapted to provide a secondary air stream, and wherein the conduit is secured to the low pressure side of the vacuum pump.

7. The apparatus of claim 5, wherein the means to create a pressure differential includes:

means to baffle the airflow flowing through the air intake assembly to increase the pressure differential between the vacuum chamber and the ambient environment.

8. A method of metering controlled amounts of water vapor into the combustion area of a combustion system, which system has an air intake assembly for introducing a stream of air into the combustion area, which includes:

placing a reservoir of water in communication with the air intake assembly;

forming a vapor chamber above the reservoir;

maintaining the volume of the vapor chamber constant regardless of the level of water in the reservoir;

flowing an airstream through the water in the reservoir into the vapor chamber to form a saturated air stream; and introducing the saturated air stream into the air intake assembly of the combustion system.

9. The method of claim 8 which includes:

creating a vacuum in the vapor chamber to effect the movement of the air stream through the reservoir and into the vapor chamber.

10. The method of claim 8 wherein the airflow created by the air intake assembly is a primary air stream and which includes:

providing a secondary air stream and further wherein said secondary air stream is the saturated air stream.

* * * * *